United States Patent [19]

Nelson et al.

[11] Patent Number: 4,835,890

[45] Date of Patent: Jun. 6, 1989

[54] INTERBLOCKING PLASTIC DISPLAY

[75] Inventors: Kenneth W. Nelson, 15 Beach St., Staten Island, N.Y. 10304; Stanley L. Roggenburg, Jr., Staten Island, N.Y.

[73] Assignee: Kenneth W. Nelson, Staten Island, N.Y.

[21] Appl. No.: 67,098

[22] Filed: Jun. 26, 1987

[51] Int. Cl.[4] ..... G09F 7/16

[52] U.S. Cl. ..... 40/616

[58] Field of Search ..... 40/616, 618; 264/246; 428/187

[56] References Cited

U.S. PATENT DOCUMENTS

| | | | |
|---|---|---|---|
| 1,953,784 | 4/1934 | Strassner et al. | 40/616 |
| 2,000,922 | 5/1935 | Church | 40/616 |
| 2,185,492 | 1/1940 | Barrett | 264/139 |
| 2,298,364 | 10/1942 | Gits et al. | 40/616 |
| 2,340,392 | 1/1944 | Lefcourt | 156/220 |
| 2,367,800 | 1/1945 | Rakas | 40/584 |
| 2,584,841 | 2/1952 | Caprez et al. | 40/629 |
| 2,586,978 | 2/1952 | Murray | 40/616 |
| 2,619,753 | 12/1952 | Lurie | 264/132 |
| 2,651,079 | 9/1953 | Michaelson et al. | 264/162 |
| 2,663,910 | 12/1953 | Danielson et al. | 264/247 |
| 2,731,672 | 1/1956 | Davis et al. | 264/132 |
| 2,839,853 | 6/1958 | Giangreco | 40/616 |
| 3,852,145 | 12/1974 | Kloweit | 40/616 |
| 2,863,241 | 12/1958 | Gits | 40/616 |
| 2,955,371 | 10/1960 | Brunner | 40/336 |
| 3,086,245 | 4/1963 | Gits | 249/83 |
| 3,226,865 | 1/1966 | Brand | 40/615 |
| 3,535,807 | 10/1970 | Baldwin | 40/618 |

*Primary Examiner*—John J. Wilson
*Assistant Examiner*—Cary E. Stone
*Attorney, Agent, or Firm*—Roger S. Thompson

[57] ABSTRACT

A display device has two interlocked contrasting elements. A first element is of a first color, and has a top surface configured to resemble desired indicia, e.g. one or more letters or numerals. The first element also has a bottom surface which includes a plurality of first locking members. A second element has a plurality of second locking members which interlock with the first locking members, and is of a second color. The second color preferably contrasts with the first color. The interlocking action of the first locking members with the second locking members serves to interlock the two contrasting elements, thereby providing a good mechanical locking action therebetween. In a first embodiment, the first and second elements together form a generally flat top surface, while in a second embodiment, the two elements are of different top levels, so that the indicia may be either raised or recessed with respect to the background.

37 Claims, 2 Drawing Sheets

INTERBLOCKING PLASTIC DISPLAY

BACKGROUND OF THE INVENTION

The present invention relates to the field of display devices, such as signs, nameplates and tags, and, more particularly, to a display device used in harsh environments where durability is at a premium.

There are many applications in which a display device is exposed to harsh environments. For example, it is often necessary to identify cables which are buried beneath the ground for extended periods, or to label outdoor utility poles with identifying information.

The particular application doesn't matter. The commonality of such applications is that the display device used to identify the cable, or label the pole, etc., must be capable of withstanding extremes of temperature, humidity (from arid desert to periodic flooding), abrasion, ultraviolet exposure or acidity, among other hazards, without undue degradation or cost.

Most consumers of such display devices, prefer to use generally identical devices for any environment, rather than purchase special display devices for each environment. This minimizes costs by permitting the purchaser to buy in quantity, and by permitting him also to reduce his inventory.

It is also preferred that the devices be as inexpensive as possible.

Thus, there is a need for a display device which is durable in any of a plurality of harsh environments, and which is also inexpensive to manufacture.

Currently, there are many display devices which attempt to fill this need. For example, there exist flat, molded or embossed metal tags upon which indicia (e.g. letters, numbers or other identifying material) are painted in a color selected to contrast with that of the background thereof. While the metal of the tags may be of fairly high durability, the painted indicia tend to abrade, peel and otherwise deteriorate, thereby rendering the tag difficult to read. Such tags are also of relatively high cost and are electrically conductive, which is often undesirable for display devices.

Other commercially available display devices comprise unitary plastic tags which may have a flat surface, or have a raised or recessed surface configured in the shape of the desired indicia. The indicia are then painted on the background material, or otherwise colored, such as by hot stamping or silk-screening, with a coating of a desired contrasting color.

Such tags are inexpensive to manufacture, but not very durable. While the type of plastic conventionally used in the tags does not degrade easily, the indicia coloring is usually not of any great thickness (generally no more than a few thousandths of an inch), and easily abrades off, or fades after prolonged exposure to ultraviolet radiation. There is a particular problem with applying a coloring to the surface of the device, since it is difficult to achieve good adhesion between the coloring and the underlying plastic.

Furthermore, there is an existing problem with the proper application of the coloring to the surface of the raised indicia, since this involves two separate aligning steps, and the device may not be properly aligned during the second step.

There exists a particular problem in the so-called "hot-stamp" process, in which the coloring of the indicia is deposited on the background with a foil colorant. Even if the colorant appears to be satisfactorily applied, its adhesion to the background material is subject to wide variation. Additionally, quality control is difficult, since each piece must be actually tested, rather than merely inspected. Alternatively, it is possible to forego inspection, resulting in a less expensive, but less reliable, product.

While there also exist many thick plastic display devices, none of them are readily adaptable to the fields of use herein described.

It is preferred that display devices be as thin as possible, since this reduces the materials cost of the device, and it also permits the display device to be more readily bent, which is necessary in some applications, e.g. labeling curved poles or cables. Furthermore, thick display devices also project further from the surface of the object being labelled, so that they are more prone to be damaged by a lateral impact thereto.

It is also known to manufacture a display device as two separate pieces: a display portion and a background portion. Such known devices, however, must be assembled, which adds manufacturing costs, and must also utilize a third, retaining, portion, to hold the other two pieces together. Thus, such devices are less attractive from a practical standpoint.

There is thus a need for an inexpensive display device having high durability in a plurality of harsh environments, particularly with respect to ultraviolet, abrasive or harsh chemical environments.

OBJECTS AND SUMMARY OF THE INVENTION

Accordingly, it is an object of the invention to provide a display device which overcomes the drawbacks of the prior art.

It is a further object of the invention to provide an inexpensive display device with high durability.

It is a still further object of the invention to provide a display device comprising two interlocked contrasting elements.

Briefly stated, there is provided a display device having two interlocked contrasting elements. A first element is of a first color, and has a top surface configured to resemble desired indicia, e.g. a letter or numeral. The first element also has a bottom surface which includes a plurality of first locking members. A second element has a plurality of second locking members which interlock with the first locking members, and is of a second color. The second color preferably contrasts with the first color. The interlocking action of the first locking members with the second locking members serves to interlock the two contrasting elements, thereby providing a good mechanical locking action therebetween. In a first embodiment, the first and second elements together form a generally flat top surface, while in a second embodiment, the two elements are of different top levels, so that the indicia may be either raised or recessed with respect to the background.

In accordance with these and other objects of the invention, there is provided a display device comprising: a display member having a top surface and a bottom surface, said display member including indicia disposed on said top surface, and further including first locking means disposed beneath said top surface; and a background member also having a top surface and a bottom surface, said background member including second locking means configured to interlock with said first locking means; whereby said display member and said background member are locked together by the interlocking of said first and second locking means.

According to a feature of the invention, there is further provided a display device comprising: a display member having a top surface configured in the shape of desired indicia, and a bottom surface disposed beneath said top surface, said bottom surface including first locking means; said display member being of a first color; and a background member also having a top surface and a bottom surface, said background member further including second locking means configured to interlock with said first locking means; said background member being of a second color contrasting with said first color; whereby said display member and said background member are locked together by the interlocking of said first and second locking means.

According to a still further feature of the invention, there is still further provided a method of making a display device comprising the steps of: forming a display member having a top surface and a bottom surface, said top surface including indicia, said display member also having an aperture therein; forming a background member about said display member, said background member also having a top surface and a bottom surface, said background member further including a locking member disposed in said aperture in said display member; wherein said background member at least partly fills in said aperture with said locking member, thereby locking said display member and said background member together.

According to a still further feature of the invention, there is still further provided a method of making a display device, comprising the steps of: forming a background member having a top surface and a bottom surface, and further including a plurality of apertures leading from said top surface to said bottom surface thereof; and forming a display member about said background member, said display member having a top section containing indicia disposed above said top surface of said background member, a bottom section disposed below said bottom surface of said background member, and a segment joining said top and bottom sections of said display member; said segment being disposed in at least one of said plurality of apertures in said background member.

According to a still further feature of the invention, there is still further provided a method of forming a plurality of display devices, comprising the steps of: forming a plurality of display members, each having a top surface and a bottom surface, each said top surface including indicia, each said display member also having an aperture therein; forming a respective plurality of background members, one each about said plurality of display member, each said background member also having a top surface and a bottom surface, and each said background member further including a locking member disposed in said aperture in said respective display member; wherein each said background member may be formed in a mold having substantially identical characteristics, regardless of the nature of said indicia; and also wherein each said background member at least partly fills in said aperture with said locking member, thereby locking each said display member and its respective background member together.

According to a still further feature of the invention, there is still further provided a method of making a plurality of display devices, comprising the steps of: forming a plurality of background members each having a top surface and a bottom surface, and each further including a plurality of apertures leading from said top surface to said bottom surface thereof, each of said plurality of background members being substantially identical; and forming a display member about each of said plurality of background members, each said display member having a top section containing indicia disposed above said top surface of its respective background member, a bottom section disposed below said bottom surface of said respective background member, and a segment joining said top and bottom sections of said display member; said section being disposed in at least one of said plurality of apertures in said background member.

According to a still further feature of the invention, there is still further provided a method of making a plurality of display devices, comprising the steps of: forming a plurality of background members each having a top surface and a bottom surface, and each further including a plurality of apertures leading from said top surface to said bottom surface thereof, each of said plurality of background members being substantially identical; and forming a display member about each of said plurality of background members, each said display member having a top section containing indicia disposed above said top surface of its respective background member, a bottom section disposed below said bottom surface of said respective background member, and a segment joining said top and bottom sections of said display member; said section being disposed in at least one of said plurality of apertures in said background member.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

Figure 1:
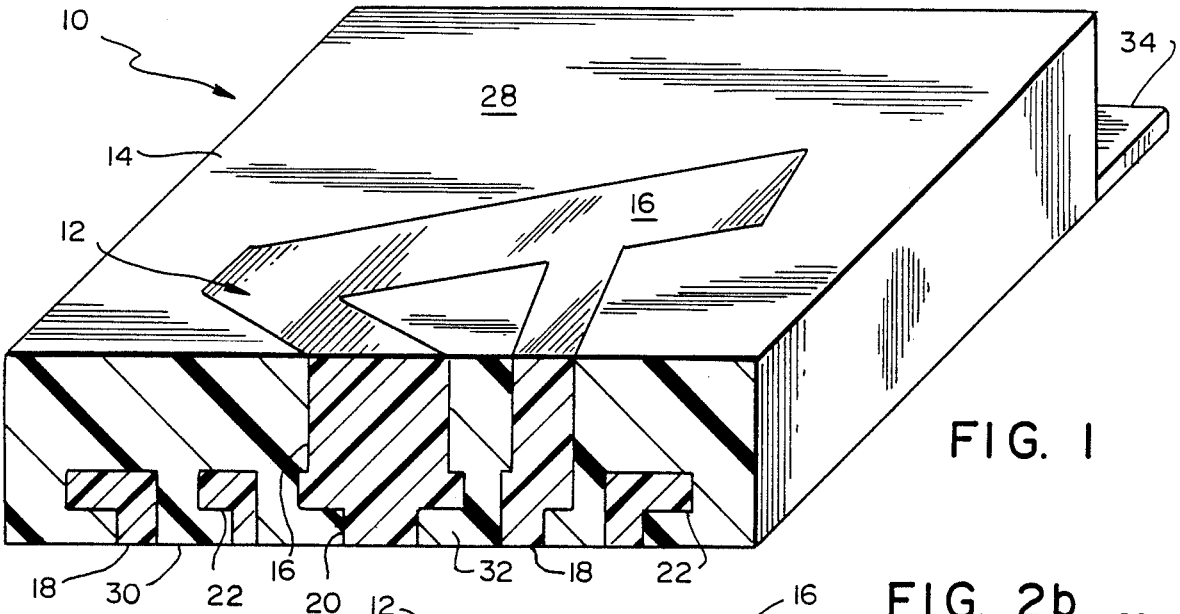
FIG. 1 is a perspective of a preferred embodiment of the inventive display device, shown partly in section.

Referring now to FIG. 1, there is shown, generally at 10, a display device, in accordance with a preferred embodiment of the invention. As shown, display device 10 includes a display member 12 and a background member 14. Each of display member 12 and background member 14 may be made of any suitable material, but, in accordance with the preferred embodiment, it is preferred that they are each of a non-electrically conductive plastic. In the most preferred embodiment, they are of polypropylene.

Both display member 12 and background member 14 may be made of the same material, or they may be of different materials. In the event that they are made of different materials, it is preferred that display member 12 may be made of the more durable, for reasons which will be discussed below.

Figure 2B:
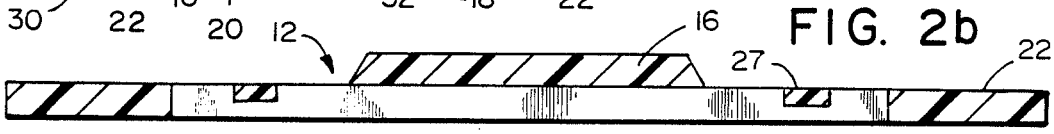
FIG. 2*b* is a cross-sectional detail of FIG. 2, taken along lines A—A of FIG. 2.
Figure 2:
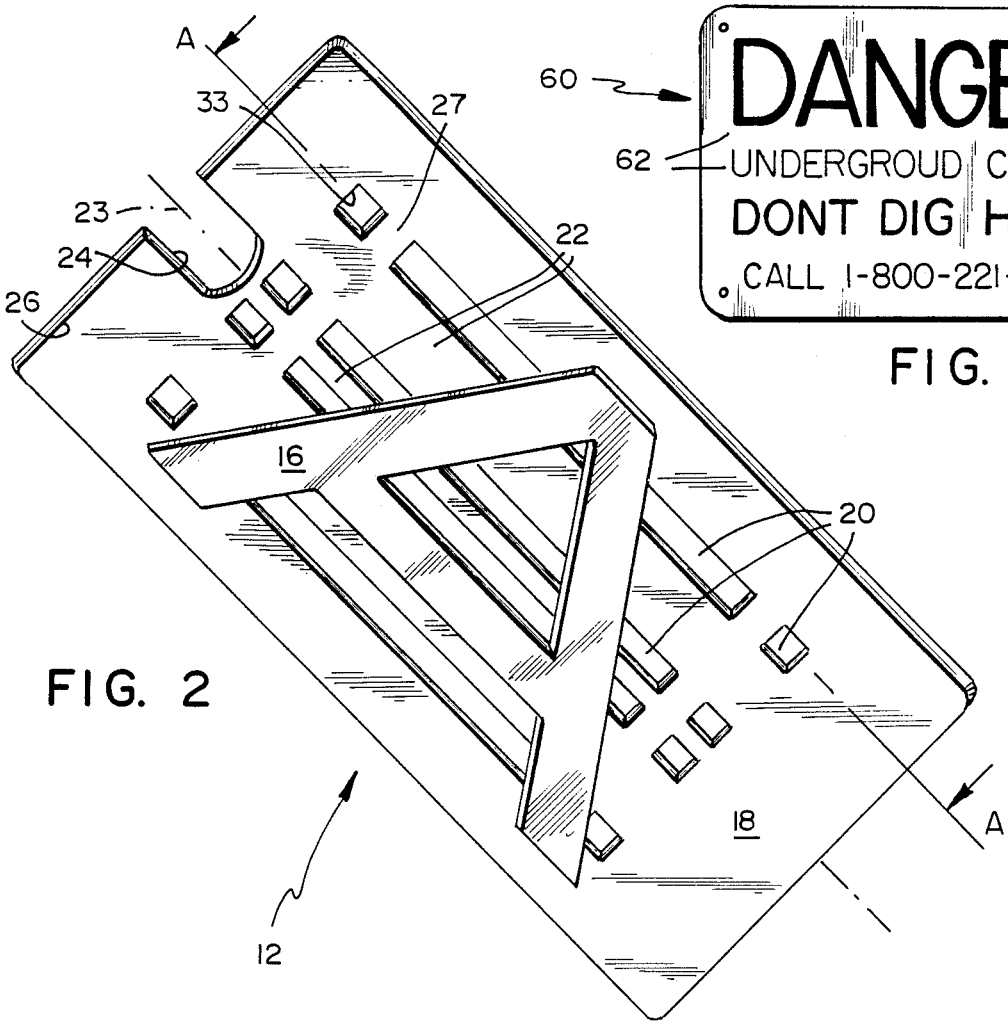
FIG. 2 is a perspective of a display member of the invention.

Display member 12 is shown in more detail in FIG. 2, to which concurrent reference is now made. Display member 12 is a unitary piece having a top section 16, and a bottom section 18. Top section 16 is configured in the shape of desired indicia, such as the letter "A", as illustrated. It will be appreciated that any indicia, such as any letter, number, logo or combination of letters, numbers and logos, could be featured in top section 16, and that the illustrated letter is used for demonstrative purposes only.

Bottom section 18 includes first locking means, such as open grooves or apertures 20 (FIG. 2) defined by ribs 22, which run generally parallel to a longitudinal axis 23. As seen most clearly in FIG. 2, bottom section 18 is a generally planar member, with open grooves 20 and a notch 24 missing therefrom. Top section 16 is above bottom section 18, and joined to ribs 22 in those places at which they are in contact. In the preferred embodiment, top section 16 has an appreciable thickness, of at least one hundredth of an inch (0.01″), and, in the most preferred embodiment, on the order of four hundredths of an inch (0.04″), or appx. 1 mm. This may be contrasted with the known display devices described above, in which the display, i.e. the coloring applied to the surface thereof, has a very slight thickness.

It will also be appreciated that the thickness of top section 16 may be easily varied for a particular application.

Figure 2A:
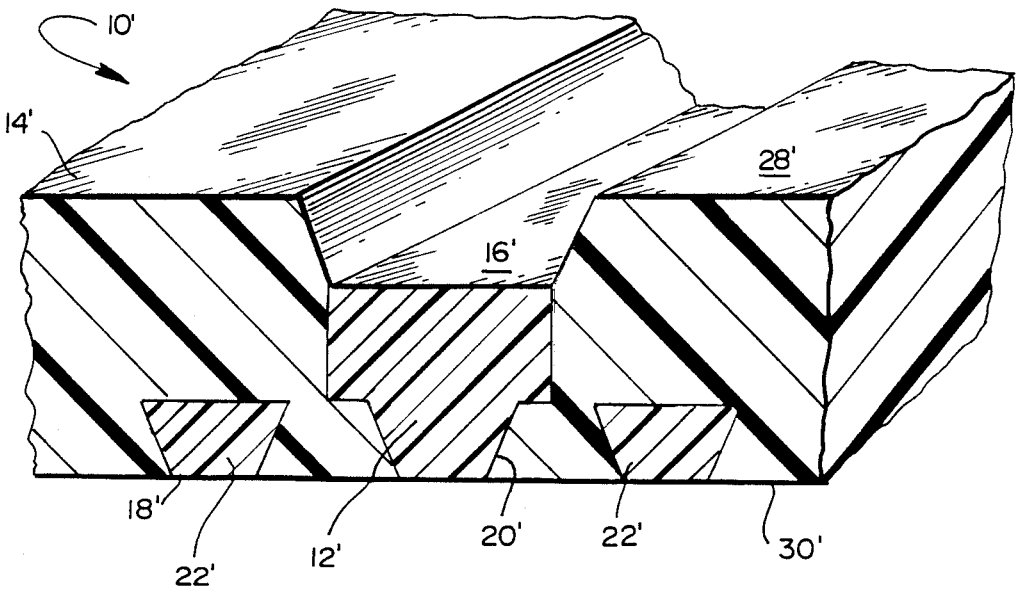
FIG. 2*a* is a perspective, shown partly in cross-section, of a slightly modified version of the display device of FIGS. 1 and 2.

As described, open grooves 20 are generally disposed parallel to longitudinal axis 23 across the width of display member 12. It will be appreciated that this orientation is not the only one possible, but that open grooves 20 may also be disposed at any angle, for example transverse to longitudinal axis 23 (see FIG. 2*a*), as desired.

Bottom section 18 further includes notch 24 disposed on an end 26 thereof.

As shown most clearly in FIG. 1, open grooves 20 are defined by ribs 22. Ribs 22 act as first locking means in conjunction with background member 14, and may be of any desired shape. In the illustrated embodiment, ribs 22 are of a stepped configuration, from top to bottom. In other embodiments, they may be of a configuration stepped in the opposite direction, or dovetailed in either direction (e.g. as in FIG. 2*a*). All that is necessary is that they act to provide a basis for background member 14 to interlock therewith as will be described presently. It is further preferred that bottom section 18 include at least one transverse rib 27 (FIG. 2) on each end thereof. In a preferred embodiment, transverse ribs 27 do not extend to the same depth as ribs 22 (see FIG. 2*b*), for reasons to be described presently.

Background member (FIG. 1) 14 includes a top surface 28, a bottom surface 30 and a plurality of tongues 32. Top surface 28 is generally co-planar with top section 16 of display member 12, and bottom surface 30 is generally co-planar with bottom section 18. Each tongue 32 is disposed within a respective open groove 20, thereby acting as a complementary locking means thereto. Furthermore, a portion (not separately shown) of each tongue 32 is disposed in an area 33 (FIG. 2) between each transverse rib 27 and an end of bottom section 18 of display member 12.

The manufacture of display device 10 according to a preferred method, is a fairly straightforward matter.

In the preferred embodiment illustrated in FIGS. 1 and 2, display device 10 has an overall cross-sectional appearance of a rectangle, or box, having a height from top to bottom, a length along longitudinal axis 23, and a width transverse to these two directions.

First, the desired indicia to be displayed by display device 10, here the letter "A", are selected. Then display member 12 is formed, with a standard bottom section 18 and a top section 16 formed as the selected indicia. It is important to stress that display member 12 is a unitary piece, and that the description of its two sections are for illustrative purposes only. The thickness of top section 16 may be selected depending upon the application for which display device 10 is intended. Preferably, the formation of display member 12 is done by injection molding, so top section 16 and bottom section 18 may be formed as a unitary member of a single piece of the desired material.

It is here noted that the number of open grooves 20 formed in bottom section 18 is not strictly relevant, although it is preferred that there be sufficient open grooves 20 to provide ample interlocking. The precise number of open grooves 20 will vary depending on the application, and the selection of a suitable number thereof is well within the capabilities of those of ordinary skill in the art.

The criteria for determining a suitable number of open grooves 20 include the width of display device 10, the size of the indicia, and the number of rows of indicia thereon. It is only necessary that there be at least one open groove 20 under every contiguous portion of the indicia, so that, when background member 14 is formed (described below) it may flow into every available space in display member 12. In the illustrated embodiment, four open grooves 20 were sufficient.

In most applications, display member 12 will be formed with a number of other display members 12, as part of a plurality of display devices, such as display device 10. They need not all bear identical indicia, and may in fact be completely different, for example different numbers or letters. In each case, however, their respective bottom sections 18 will be substantially identical, with open grooves 20 therein.

In the second step, the formed display member 12 is permitted to cool, as necessary, and inserted into a second mold (not shown) having a substantially rectangular cross-section for the completion thereof. This next step is also preferably performed by injection molding of the material of which background member 14 is comprised.

It is preferred that the height of the mold be equal to the height of display member 12, so that there is no possibility of any material of background member 14 being deposited atop display member 12, thereby obscuring the indicia thereof.

The width (i.e. the direction transverse to longitudinal axis 23 in the plane of bottom section 18) of the mold, and therefore of 14, is preferably wider than bottom section 18, but not necessarily. This is a design preference of the user, and of no importance to the invention.

Finally, the length of the mold (i.e. the measurement along longitudinal axis 23) may or may not be equal to that of display member 12, thereby completely encapsulating display member 12, or leaving a portion thereof to act as a flange 34 (FIG. 1) as desired. Flange 34 is useful in certain applications wherein display device 10 is deployed with other similar devices in a holder (not shown) having a channel therein into which flange 34 may fit. This is the case in many applications where display device 10 may be used to identify, for example, utility poles or underground cables, and a multiplicity of different indicia will be required to identify each pole etc. uniquely.

Background member 14 may be aligned within the mold by notch 24, thereby ensuring proper registry of display member 12 and background member 14. This eliminates a problem faced by the prior art, namely the application of coloring to the wrong part of the surface of the device. Furthermore, since background member 14 is merely intended to fill in the background of display device 10, and does not impact on the actual display of the indicia, per se, there is no problem with registering display member 12 and background member 14 for two separate, precise, alignments as was necessary in the prior art.

It will be appreciated that the complementary nature of background member 14 with respect to display member 12 means that the mold used to create background member 14 need not be varied, regardless of the nature of the desired indicia. The background may be standardized for all possible indicia, since background member 14 will merely fill the gaps in display member 12. Specifically, as background member 14 is molded, the material thereof is forced into open grooves 20, thereby forming tongues 32 therein, and also filling in all open spaces in the indicia. As the material flows into open grooves 20, it goes both above and below transverse ribs 27, which, as stated, are not as deep as ribs 22, thereby permitting background member 14 to encircle completely transverse ribs 27. Thus, background member 14 firmly interlocks with display member 12, since a portion of background member 14 is beneath a portion of display member 12, and a portion of display member 12 is beneath a portion of background member 14, regardless of the form of the desired indicia.

Additional interlocking action is provided by the fact that background member 14 also completely encircles the lateral edges of display member 12, thereby encapsulating display member 12 without the need for a peripheral locking element. This also serves to lessen the possibility of seepage of contaminants between the border of display member 12 and background member 14.

The interlock permits the secure, mechanical, binding of display member 12 and background member 14, thereby ensuring the integrity of display device 10.

This design also ensures the production of a display device 10 which is of improved durability. Since top section 16 comprises the desired indicia, and is made of a material which contrasts with top surface 28, the actual material which displays the desired indicia is of greatly increased thickness compared to known display devices. Furthermore, since the indicia extend deeply into the body of display device 10, they may not be easily abraded away. Rather than having a fragile layer of coloring on top of display device 10, top section 16 has a substantial thickness, which is capable of withstanding substantial abuse before becoming unreadable. With the selection of a suitable material for display member 12, it is possible to ensure that the indicia will withstand wide variations of environments with a reasonable degree of certainty as to the expected lifetime of display device 10.

It is noted that, if it is desired to use two different materials for display member 12 and background member 14, it is preferred that the first molded material be of sufficient durability to withstand the second molding process.

Minor alterations of the embodiment of FIGS. 1 and 2 are shown in FIG. *2a*, wherein transverse open grooves 20' are shown, having a dovetailed profile. In addition, top section 16' is shown recessed with respect to top surface 28'. In the event that a particular embodiment calls for the use of recessed indicia, then the alterations of FIG. *2a* would be preferred. The manufacture thereof is identical with that of the preferred embodiment, except that the mold for background member 14' includes a projection (which forms a recess in background member 14') matching generally the outlines of the desired indicia. This process is only slightly more difficult than that of the primary embodiment, owing to the obvious necessity for aligning the second mold with the indicia. Otherwise, this embodiment is identical to that of the preferred embodiment.

Figure 3:
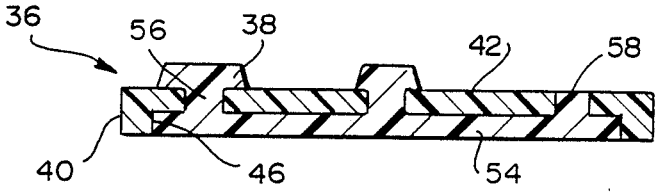
FIG. 3 is a cross-section of a display device of a secondary embodiment of the invention.

In certain other applications, it may be preferred that display device 10 include raised indicia, i.e. indicia which lie above the plane of the background material. Such an arrangement is shown in FIG. 3.

As shown, a secondary embodiment of the invention may comprise a display device 36. Display device 36 includes a display member 38 and a background member 40, similar to display device 10 of FIGS. 1 and 2, except that display member 38 extends above a top surface 42 of background member 40.

In this embodiment, it is preferred that background member 40 be formed first. Since the indicia are above top surface 42, it is possible for each background member 40 to be identical, as shown in FIG. 4.

Background member 40 includes a plurality of apertures 44 formed in top surface 42, and may be formed with a generally open bottom cavity 46, and opposed flanges 48 and 50, if flanges are desired. Apertures 44 may be of any desired shape, such as square or round (shown), the shape of the indicia or some irregular shape. It is to be noted that this will be true regardless of whether the indicia is raised. Flange 50 includes a notch 52 therein, which communicates with bottom cavity 46, as do apertures 44.

Figure 4:
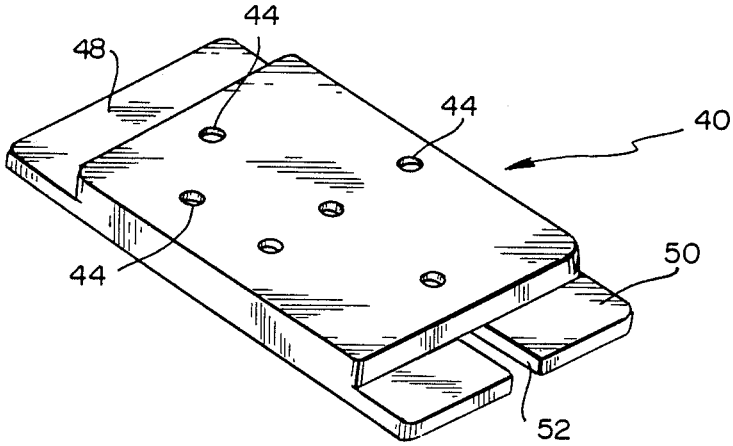
FIG. 4 is a plan view of a background member of the embodiment of FIG. 3.

In terms of the procedure of its manufacture, display device 36 is the exact opposite of display device 10, in that background member 40 is formed first, as shown in FIG. 4. This means that a number of "blank" background members 40 may be made before any particular application is known. Once background member 40 is formed, preferably, again, by injection molding, it may be used for any desired indicia. For this reason, it is preferred that there be a number of apertures 44 formed in background member 40. It is necessary that at least one, and preferably more than one, aperture 44 underlie any desired indicia for a particular application, thereby providing an outlet for the molding of display member 38, as described below. The precise distribution and location of apertures 44 will depend upon the range of indicia to be used, so that apertures 44 underlie the indicia to be used, with minimal chance for "dotting", discussed below.

Returning now to FIG. 3, after background member 40 is formed and cooled, display member 38 is formed, once more by injection molding. Background member 40 is placed into a mold, and the desired material is injected through notch 52 (FIG. 4), into bottom cavity 46, forming a backing 54 therein. As backing 54 fills bottom cavity 46, the material extrudes through each aperture 44, forming sections 56 therein. Those sections 56 which underlie the open ares of the mold extrude past top surface 42 to form display member 38. Those sections 56 which do not underlie those open areas do not, thereby forming dots 58 on the surface of top surface 42. As mentioned, it is preferred that as few apertures 44 as possible not underlie indicia, thereby minimizing the presence of dots in the final product.

Flanges 48 and 50 may be used to hold display device 36 in a holder (not shown) as could display device 10.

Thus, according to either method of manufacture, it is possible to form interlocking display devices which have relatively thick display members and high durability.

Figure 5:
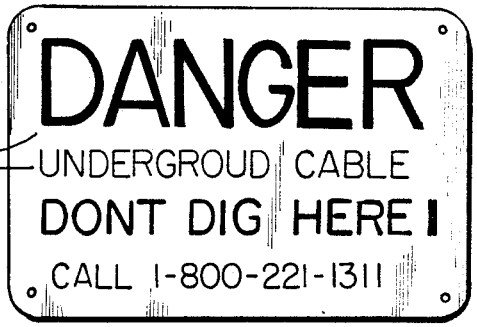
FIG. 5 is a plan view of a secondary embodiment of the invention, showing a display device having more than one row of indicia thereon.

It will be appreciated that the described embodiment is merely the preferred embodiment, and that variations may be made. For example, as shown in FIG. 5, a display device 60 may have several lines of indicia 62 thereon. This is accomplished in the same fashion as described in relation to a single line of indicia, except that the entire display device is larger and has a greater number of grooves and tongues or dots (not shown in FIG. 5) for interlocking each part of indicia 62.

It will also be appreciated that it is possible to have more than two colors used in the manufacture of a display device, perhaps with two differently colored portions of indicia, or two or more different colors for the background. Many different applications for such a display device could exist, and each falls with the scope of this disclosure.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A display device comprising:

a display member having a top surface and a bottom surface, said display member including indicia disposed on said top surface, and further including first locking means disposed beneath said top surface; and a background member also having a top surface and a bottom surface, said background member including second locking means configured to interlock with said first locking means;

said first locking means including a portion having a bottom surface disposed closer to the top surface of said display member than said bottom surface of the remainder of said first locking means; and said second locking means substantially underlying said portion of said first locking means;

whereby said display member and said background member are locked together by the interlocking of said first and second locking means, particularly by the underlying of said portion of said first locking means by said second locking means.

2. The display device of claim 1, wherein said top surface of said display member and said top surface of said background member are generally co-planar.

3. The display device of claim 1, wherein said top surface of said display member is further from said bottom surface thereof than is said top surface of said background member.

4. The display device of claim 1, wherein said top surface of said display member is closer to said bottom surface thereof than is said top surface of said background member.

5. The display device of claim 1, wherein said first locking means includes at least one open groove.

6. The display device of claim 5, wherein said at least one open groove is disposed longitudinally with respect to a longitudinal axis of said display device.

7. The display device of claim 5, wherein said at least one open groove is disposed transverse to a longitudinal axis of said display device.

8. The display device of claim 5, wherein said second locking means includes at least one tongue disposed within said at least one open groove.

9. The display device of claim 8, wherein said at least one open groove is dovetailed, and said at least one tongue is complementarily dovetailed.

10. The display device of claim 8, wherein said at least one open groove is stepped from top to bottom thereof, and said at least one tongue is complementarily stepped from top to bottom thereof.

11. The display device of claim 1, wherein said background member includes a plurality of apertures therein, and said first locking means includes at least one segment disposed in at least one of said plurality of apertures;

whereby said background member and said display member are locked together by said segment and said at least one of said plurality of apertures.

12. The display device of claim 11, wherein said display member includes a first section disposed above said top surface of said background member, and a second section disposed below said bottom surface of said background member, and said first and second sections are joined by said segment;

whereby said first and second sections act to clamp said display member to said background member.

13. The display device of claim 1, wherein one of said display member and said background member includes a notch therein; and the other of said display member and said background member is at least partly disposed within said notch;

whereby said display member and said background member may be aligned by said notch.

14. A display device comprising:

a display member having a top surface configured in the shape of desired indicia, and a bottom surface disposed beneath said top surface, said bottom surface including first locking means;

said first locking means including a portion having a bottom surface disposed closer to the top surface of said display member than said bottom surface of the remainder of said first locking means;

said display member being of a first color; and a background member also having a top surface and a bottom surface, said background member further including second locking means configured to interlock with said first locking means;

said second locking means substantially underlying said portion of said first locking means;

said background member being of a second color contrasting with said first color;

whereby said display member and said background member are locked together by the interlocking of said first and second locking means, particularly by the underlying of said portion of said first locking means by said second locking means.

15. The display device of claim 14, wherein said top surface of said display member and said top surface of said background member are generally co-planar.

16. The display device of claim 14, wherein said top surface of said display member is further from said bottom surface thereof than is said top surface of said background member.

17. The display device of claim 14, wherein said top surface of said display member is closer to said bottom surface thereof than is said top surface of said background member.

18. The display device of claim 14, wherein said first locking means includes at least one open groove.

19. The display device of claim 18, wherein said at least one open groove is disposed longitudinally with respect to a longitudinal axis of said display device.

20. The display device of claim 18, wherein said at least one open groove is disposed transverse to a longitudinal axis of said display device.

21. The display device of claim 14, wherein said background member includes a plurality of apertures therein, and said first locking means includes at least one segment disposed in at least one of said plurality of apertures;

whereby said background member and said display member are locked together by said segment and said at least one of said plurality of apertures.

22. The display device of claim 21, wherein said display member includes a first section disposed above said top surface of said background member, and a second section disposed below said bottom surface of said background member, and said first and second sections are joined by said segment;

whereby said first and second sections act to clamp said display member to said background member.

23. The display device of claim 14, wherein one of said display member and said background member includes a notch therein; and the other of said display member and said background member is at least partly disposed within said notch;

whereby said display member and said background member may be aligned by said notch.

24. The device of claim 14, wherein said display member is formed of a first plastic;

said background member is formed of a second plastic; and said first plastic is at least as durable as said second plastic.

25. The display device of claim 14, further comprising:

a flange, affixed to at least one of said display member and said background member, for coupling said display device to a holder;

whereby said display device may be used with other similar display devices to identify an object with which said display device is used.

26. The display device of claim 14, wherein said display member has a thickness of at least one hundredth of an inch (0.01").

27. A method of making a display device comprising the steps of:

forming a display member having a top surface and a bottom surface, said top surface including indicia, said display member also having an aperture therein;

said display member further having a portion having a bottom surface disposed closer to the top surface of said display member than said bottom surface of the remainder of said display member;

forming a background member about said display member, said background member also having a top surface and a bottom surface, said background member further including a locking member disposed in said aperture in said display member; and underlying said portion of said display member with said background member;

wherein said background member at least partly fills in said aperture with said locking member, thereby locking said display member and said background member together.

28. The method of claim 27, further comprising the step of:

forming said top surface of said background member so that it is substantially co-planar with said top surface of said display member.

29. The method of claim 27, further comprising the steps of:

forming a notch in said display member; and aligning said background member with said notch, thereby ensuring that said display member and said background member are in register during their respective formations.

30. A method of making a display device, comprising the steps of:

forming a background member having a top surface and a bottom surface, and further including a plurality of apertures leading from said top surface to said bottom surface thereof; and forming a display member about said background member, said display member having a top section containing indicia disposed above said top surface of said background member, a bottom section disposed below said bottom surface of said background member, and a segment joining said top and bottom sections of said display member;

said segment being disposed in at least one of said plurality of apertures in said background member, forming a notch in said background member; and aligning said display member with said notch in said background member, thereby ensuring that said display member and said background member are in register during their respective formations.

31. A method of forming a plurality of display devices, comprising the steps of:

forming a plurality of display members, each having a top surface and a bottom surface, each said top surface including indicia, each said display member also having an aperture therein;

each said display member further having a portion having a bottom surface disposed closer to the top surface of said display member than said bottom surface of the remainder of said display member;

forming a respective plurality of background members, one each about said plurality of display member, each said background member also having a top surface and a bottom surface, and each said background member further including a locking member disposed in said aperture in said respective display member;

wherein each said background member may be formed in a mold having substantially identical characteristics, regardless of the nature of said indicia; and also wherein each said background member at least partly fills in said aperture with said locking member and at least partly underlies said portion of said display member, thereby locking each said display member and its respective background member together.

32. The method of claim 31, further comprising the step of:

forming said top surfaces of said plurality of background members so that they are substantially coplanar with said top surface of its respective display member.

33. The method of claim 31, further comprising the steps of:

forming a notch in each said display member; and aligning the respective background member with said notch in each display member, thereby ensuring that each said display member and its respective background member are in register during their respective formations.

34. A method of making a plurality of display devices, comprising the steps of:

forming a plurality of background members each having a top surface and a bottom surface, and each further including a plurality of apertures leading from said top surface to said bottom surface thereof, each of said plurality of background members being substantially identical; and forming a display member about each of said plurality of background members, each said display member having a top section containing indicia disposed above said top surface of its respective background member, a bottom section disposed below said bottom surface of said respective background member, and a segment joining said top and bottom sections of said display member;

said section being disposed in at least one of said plurality of apertures in said background member, forming a notch in each said background member; and aligning the respective display member with said notch in each said background member, thereby ensuring that each said display member and its respective background member are in register during their respective formations.

35. A display device comprising:

a display member having a top surface configured in the shape of desired indicia, and a bottom surface disposed beneath said top surface, said bottom surface including first locking means;

said first locking means including at least one open groove said display member being of a first color; and a background member also having a top surface and a bottom surface, said background member further including second locking means configured to interlock with said first locking means;

said second locking means including at least one tongue disposed within said at least one open groove;

said background member being of a second color contrasting with said first color;

whereby said display member and said background member are locked together by the interlocking of said first and second locking means.

36. The display device of claim 35, wherein said at least one open groove is dovetailed, and said at least one tongue is complementarily dovetailed.

37. The display device of claim 35, wherein said at least one open groove is stepped from top to bottom thereof, and said at least one tongue is complementarily stepped from top to bottom thereof.

* * * * *